United States Patent [19]

Hosegood et al.

[11] Patent Number: 4,565,717

[45] Date of Patent: Jan. 21, 1986

[54] ANTISOILING TREATMENT OF SYNTHETIC FILAMENTS

[75] Inventors: Edward A. Hosegood, Salisbury, Md.; Ludwig E. Seufert, Seaford, Del.

[73] Assignee: E. I. DuPont De Nemours and Company, Wilmington, Del.

[21] Appl. No.: 543,758

[22] Filed: Oct. 20, 1983

[51] Int. Cl.[4] ..... B05D 3/04

[52] U.S. Cl. ..... 427/339; 252/8.9; 427/342; 427/386; 427/389.9; 427/412

[58] Field of Search ..... 427/342, 339, 386, 389.9, 427/407.1, 412; 252/8.9

[56] References Cited

U.S. PATENT DOCUMENTS

| | | | |
|---|---|---|---|
| 2,902,398 | 9/1959 | Schroeder | 156/329 X |
| 3,061,473 | 10/1962 | Tesoro | 427/389.9 |
| 3,329,661 | 7/1967 | Smith et al. | 260/79.3 |
| 3,775,150 | 11/1973 | McClary | 156/110 A |
| 3,923,715 | 12/1975 | Dettre et al. | 260/29.6 R |
| 3,941,849 | 3/1976 | Herold | 528/102 X |
| 3,958,054 | 5/1976 | McKee, Jr. et al. | 427/342 X |
| 3,968,066 | 7/1976 | Mueller | 528/67 X |
| 4,029,585 | 6/1977 | Dettre et al. | 252/8.6 |
| 4,192,754 | 3/1980 | Marshall et al. | 252/8.8 X |
| 4,264,484 | 4/1981 | Patel | 428/96 X |
| 4,325,857 | 4/1982 | Champaneria et al. | 523/412 |

*Primary Examiner*—Thurman K. Page

[57] ABSTRACT

Antisoiling properties of polyamide filaments are enhanced upon melt-spinning by using a spin finish comprised of a textile lubricant, an antisoiling fluorochemical and an epoxy resin.

7 Claims, No Drawings

ANTISOILING TREATMENT OF SYNTHETIC FILAMENTS

DESCRIPTION

1. Technical Field

This invention relates to a process for enhancing the soil resistance of synthetic polyamide filaments by applying an antisoiling fluorochemical to them during their manufacture and more specifically to such use of a fluorochemical in combination with an epoxy resin.

2. Background Art

Textile articles such as fabrics and tufted pile carpets can be made more soil resistant as well as water and oil repellant by surface treatments with certain fluorochemical compounds. A variety of such treatments and treating agents are known as represented by U.S. Pat. Nos. 4,264,484; 4,029,585 and 4,192,754. The agents employed include fluorochemicals comprised of carboxylate esters of perfluoroalkyl aliphatic alcohols. Improvements are continually being sought to make such treatments more effective and more durable to cleaning and to wear, as well as to reduce their cost.

Epoxy chemicals have been used in combination with antisoiling fluorochemicals to treat various articles to improve their soil resistance but have not performed completely satisfactorily and present processing and handling problems when applied to filaments. U.S. Pat. No. 3,329,661 relates to the use of copolymers of vinyl monomers where one monomer contains fluorocarbon groups and another contains an epoxy group. The recurring epoxy groups are said to provide improved durability to cleaning of articles treated with such copolymers. U.S. Pat. No. 3,061,473 concerns a treatment for textile materials to impart antisoiling and antistatic properties which employs a fluorochemical, an antistatic polymer containing amino groups and a polyfunctional epoxide. For various reasons such compositions generally are not suitable for direct application to filaments or fibers during their manufacture and prior to their fabrication into articles to be made therefrom, such as a carpet.

DISCLOSURE OF THE INVENTION

An object of this invention is an improved process for applying an antisoiling fluorochemical in combination with an epoxy chemical to synthetic filaments during their manufacture. Another object is an improved process for applying an antisoiling spin finish composition to filaments.

Other objects will be apparent from the following description and claims.

This invention provides a process for producing synthetic polyamide filaments and fibers of enhanced soil resistance by the application of an antisoiling agent to the filaments as part of a yarn finish composition which is applied to the filaments during a melt-spinning process which spinning process comprises applying to freshly solidified filaments a primary, or first, finish composition containing a textile lubricant, an antisoiling fluorochemical and an uncured epoxy resin; and subsequently applying any epoxy curing agent to the filaments, preferably from a second finish composition containing a lubricant and a curing agent for the epoxy resin. For best results the first finish composition is applied to the filaments prior to their being drawn. Durability is improved if the filaments are heated after the first finish is applied and before the filaments are packaged. They should be heated to a temperature above a temperature at which the fluorochemical softens and spreads over the filament surface; this will also promote epoxy curing.

Suitable antisoiling fluorochemicals include those containing one or more perfluoroaliphatic radicals of at least 3 carbon atoms, and particularly 6 to 14 carbon atoms, as described in U.S. Pat. Nos. 4,264,484; 4,029,585 and 4,192,754. Generally, the fluorochemical should contain from about 40 to 80% by weight of carbon-bonded fluorine. Particularly preferred are perfluoroalkyl esters of carboxylic acids where the acid contains from 3 to 30 carbon atoms. Even more preferred are such esters which are volatile at about 200° C. to 300° C. as taught in U.S. Pat. No. 3,923,715 and particularly wherein the acid is citric acid, especially a citric acid urethane as further described in U.S. Pat. No. 4,029,585.

Exemplary epoxy resins include aliphatic (including cycloaliphatic) glycidyl ethers, aromatic glycidyl ethers and aromatic glycidyl esters including those taught in U.S. Pat. No. 2,902,398. To facilitate effectiveness and utility in this invention, the resin preferably is a liquid at room temperature. It should have an epoxy equivalent of 200 or less and a molecular weight of less than 500. Epoxy resins of this type are described in U.S. Pat. No. 3,775,150. As pointed out therein, higher molecular weight resins are insoluble in water and difficult to emulsify.

Effective epoxy curing agents which are to be applied to the filaments subsequent to the application of the epoxy resin include aliphatic polyamines such as triethylene tetramine, tetraethylene pentamine and polyethylene imine. Many suitable curing agents are known in the art and can be selected on the basis of the particular epoxy resin employed and on compatibility with the processing conditions and finish components used. Application of the curing agent to the filaments after application of the epoxy resin not only avoids possible instability problems of the finish composition (if the curing agent and the epoxy resin are present in the same finish) but generally results in more effective antisoiling performance by permitting the antisoiling fluorochemical and the epoxy resin to be applied simultaneously to a fresh clean filament surface. Such simultaneous application of the epoxy resin and fluorochemical is particularly effective when the filaments are drawn subsequent to their application which exposes additional freshly generated filament surface immediately to the treating agents.

The process of this invention has been found to provide better operability by having the fluorochemical and the epoxy resin in the first or primary finish as compared with having the fluorochemical and the curing agent in the primary finish. It is preferred that the fluorochemical and epoxy resin be applied to the filaments before subjection to heat, such as in a conventional hot chest commonly employed to preheat filaments prior to their being bulked as in a hot fluid jet bulking operation, but it has been found unnecessary to apply the curing agent before such heating. Consequently the curing agent can be applied conveniently with a conventional secondary finish, for instance as commonly practiced in the manufacture of bulked carpet yarns.

The antisoiling fluorochemical is to be applied to the filaments in an effective amount to achieve the level and durability of antisoiling protection desired. An effective amount for use in carpet yarn is that which will provide at least about 150 ppm of fluorine, and preferably 250 ppm, on the carpet after dyeing. As applied, this can be from about 0.08 to 0.20% by weight of filament of the fluorochemical. At higher concentrations the coating is usually no more effective and thus becomes uneconomical.

The epoxy resin is applied in an amount by weight equal or less than that of the fluorochemical, and preferably less than half that of the fluorochemical. Too much epoxy resin interferes with antisoiling performance. A typical weight ratio for the fluorochemical to the epoxy resin is within the range of 1:1 to 3:1. Within this range, as the ratio of fluorochemical to epoxy is increased it has been found that the retention of fluorochemical retained in carpets through beck dyeing and floor performance is improved. On the other hand, floor performance decreases when the epoxy level becomes too low.

A preferred epoxy resin is the diglycidyl ether of bisphenol A, available commercially as "Epon" 826. Polyethylene imine having a molecular weight of about 600 is a preferred curing agent for use therewith known as PEI-6 from Dow Chemical Co.). The usual safety precautions should be practiced by operators when handling such materials including the wearing of goggles and gloves.

The amount of curing agent applied can vary over a wide range depending on the type used and the amount and nature of the epoxy resin already on the filaments. Enough should be used to partially or fully cure the epoxy resin. Excess curing agent should be avoided both as being wasteful and as being possibly harmful to subsequent yarn processing. Exemplary amounts vary from 0.5% to 33% by weight of the epoxy resin. Epoxy curing agents as known in the art and as taught for use in U.S. Pat. No. 2,902,398 can be used. After curing a scavenging agent such as triethanol amine can be used to reduce free epoxide groups to an acceptable level if needed.

EXAMPLE 1

This example demonstrates antisoiling performance in carpets from applying a fluorochemical and an epoxy resin to filaments from a primary finish bath.

Experiments are run in which bulked continuous filament carpet yarns of 66-nylon are prepared in a conventional coupled spin-draw-bulking process. Poly(hexamethylene adipamide) is melt-spun through a spinneret to form a yarn of 70 filaments of trilobal cross section with a modification ratio of 2.3 to provide a total final denier of 1300. Cool air is blown transversely across the molten filaments to solidify them. A primary (or spin) finish is applied to the freshly solidified undrawn filaments by means of a standard finish roll which just touches the moving threadline and is partly immersed in a pan containing the finish bath. The spun filaments are then led to a pair of feed rolls from which they are drawn at a ratio of about 3.2X in a continuous operation over two pairs of draw pins arranged in tandem by a pair of heated draw rolls located in an insulated heated chest (as represented for example in FIG. 1 of U.S. Pat. No. 3,971,202 but without the introduction of second yarn 10 as shown therein). Then the preheated filaments are bulked and relaxed in a hot fluid jet in combination with a screen surface on a rotating drum which collects the filaments and from which they are then taken up by a roll around appropriate guide rolls and forwarded to a conventional windup roll and wound into a package. A secondary finish is applied to the yarn by an apparatus which continuously meters the finish onto the running yarn at a location between the take-up roll and the wind-up.

In a first experiment, designated item A, primary and secondary finishes are each applied at a rate to provide about 0.2% of each finish on a dry basis based on the total weight of yarn and finish. The primary finish on a weight basis consists of 8% of an ethylene/propylene copolymer polyalkylene glycol lubricant commercially available as "Ucon" 50-HB-170 made by Union Carbide; 0.09% of the sodium salt of an alkyl aryl polyether sulfonate dispersing agent ("Triton" X-200 made by Rohm and Hass), 2% of a perfluoroalkyl citrate urethane of 1,6-hexamethylene diisocyanate, of the type described in U.S. Pat. No. 4,029,585, (the perfluoroalkyl citrate triester is made from a mixture of fluorinated alcohols having the formula $C_nF_{2n+1}(CH_2)_mOH$ wherein n is 6 to 14 and m is 2, the fully esterified citric acid is made into a bis-urethane by reacting 2 mols of the citrate triester with 1 mol of 1,6-hexamethylene diisocyanate); 2% of an epoxy resin which is a diepoxide of epichlorohydrin and bisphenol A with an epoxide equivalent of 180; and the remainder of the finish constituting about 88% water. The secondary finish consists of about 10% of the same lubricant with the remainder being water.

In a boil-off test to test durability of the treatment to scouring, the fluorine content before and after boil-off is found to be 170 and 160 ppm respectively. When this experiment is repeated except that the secondary finish contains 0.2% of tetraethylenepentamine the yarn before boil-off contains 430 ppm fluorine and 410 ppm after boil-off.

The bulked yarn is tufted into a carpet which is subsequently dyed in a beck. Analysis of yarn taken from the carpet shows about 110 parts per million (ppm) of fluorine by weight of yarn as compared with 170 ppm on the bulked yarn as made.

Control carpets B not of the invention are similarly made and dyed but without the fluorochemical in the finish. For B, both the primary and secondary finishes consist of 10% of the same lubricant and the remainder water for a finish pickup of 0.15% for each. The soiling performance of A and B carpets is compared to two similar carpets made from yarn containing no fluorochemical but then each topically treated with one of two commercial topical antisoiling agents ("Zepel" by E. I. du Pont de Nemours and Company and "Scotchgard" by the 3M Company). All of the carpets are experimentally tested by exposure to heavy pedestrian traffic in a controlled test in a transportation terminal building in which the frequency of the traffic is monitored. After a few days carpet A begins, and continues, to outperform both of the topically treated controls, as well as the untreated control B.

Additional experiments are run to test the effects of various possible combinations of and order of application of the fluorochemical, the epoxy resin and the curing agent in the primary and secondary finish bath. Whereas better operability (fewer yarn breaks) is observed with the fluorochemical and the curing agent is the primary finish, the best antisoiling performance is obtained with the fluorochemical and the epoxy resin in the primary finish. Process operability is better for the combination of fluorochemical and epoxy resin in the primary finish than for the fluorochemical with no epoxy resin in the primary finish. It is found for best fluorine retention that the fluorochemical, the epoxy resin and the curing agent should all be applied to the filaments before the hot chest. When the finish lubricant is applied alone as the primary finsh and the fluorochemical is applied with the secondary finish, the fluorine retention is much poorer than if the latter is applied in the primary finish.

Floor tests of residential carpet constructions confirm that better results are obtained if both the fluorochemical and the epoxy resin are applied from the primary finish, consistent with the fluorine retention after boil-off.

The experiment of A is substantially repeated except that the curing agent in the secondary finish is poly(ethylene imine) having a molecular weight of about 600 (PEI-6). When analyzed for fluorine content, the yarn before and after boil-off is found to contain 144 and 114 ppm of fluorine respectively. When the process is repeated but without either the epoxy resin or the curing agent, the fluorine contents before and after boil-off are 232 and 66 respectively.

EXAMPLE 2

Bulked continuous filament carpet yarns of 66 nylon are prepared according to the invention in a coupled spin draw-bulking process substantially as described in Example 1. The composition of the primary finish is made so as to compare amounts of the fluorochemical to epoxy resin ratios of 1.0 and 1.7, while maintaining the amount of fluorochemical picked up by the fiber at about 800 ppm.

The primary finish with a fluorochemical to epoxy resin ratio of 1.0 (Item X) consists of 10% of an ethylene/propylene copolymer polyethylene glycol lubricant commercially available as Ucon 5100 made by Union Carbide; 2% of a perfluoroalkyl citrate urethane of Example 1; 2% of an expoy resin which is a diepoxide of epichlorohydrin and bisphenol A with an epoxide equivalent of 180; 2% of an ethoxylated castor oil, added from 100% material, consisting of one mol of castor oil, 25 moles of ethylene oxide and 2 moles of oleic acid (Synlube 728 manufactured by Milliken Chemical Co.). The secondary finish consists of 10% of a similar lubricant of lower viscosity (an ethylene/propylene copolymer polyalkylene glycol commercially available as Ucon 50-HB-170 made by Union Carbide) and 0.2% polyethylene amine (PEI-6 made by Dow Chemical Co.) and the rest water.

In another test, the primary finish with a fluorochemical to epoxy resin ratio of 1.7 (Item Y) consists of all the same constituents except the amount of the same perfluoroalkyl citrate urethane is increased from 2% to 3.5%. The secondary finish is identical to that for Item X.

When analyzed for fluorine content, the yarns before and after boiloff are found to contain 840 and 680 ppm respectively for Item Y compared to 794 and 290 ppm for Item X, demonstrating that higher fluorine retention is attained by increasing the fluorochemical to epoxy resin ratio from 1.0 to 1.7.

Further experiments indicate that this ratio can be increased still further to about 3.0 with suitable results. An advantage of this higher ratio is that for a given fluorine on yarn level the amount of free epoxide on the yarn after processing can be reduced to more acceptable limits (<0.003%).

EXAMPLE 3

This example demonstrates a process of this invention for manufacturing staple fibers. This example uses the same fluorochemical, epoxy resin and curing agent as in Example 2.

Staple fibers of poly(hexamethylene adipamide) are prepared in a conventional manner in which a primary finish is applied to the freshly solidified melt-spun filaments from a conventional finish roll. Filaments from a number of spinneret positions are combined to form a rope and the rope is piddled into an appropriate container. A secondary finish is applied to the rope in two streams applied to opposite sides of the rope while it is being forwarded to the container. Ropes from one or more containers are then passed over driven rolls on a draw machine and drawn 3.0X their original length. Afterwards they are crimped and cut into staple fibers 7.5 inches (19.05 cm) in length. The fibers have about 27 crimps/inch (10.6/cm) and a 2.3 MR trilobal cross section and a dpf of 10.

For staple Item A, the primary finish consists of 6.8% of an ethylene/propylene copolymer polyalkylene glycol lubricant (commercially available as Ucon 5100—made by Union Carbide); 2.07% of the perfluoroalkyl citrate urethane of Example 1; 2.07% of an epoxy resin which is a diepoxide of epichlorohydrin and bisphenol A with an epoxide equivalent of 180; 3.11% of an ethoxylated castor oil, added from a 100% liquid consisting of one mole of castor oil reacted with 25 moles of ethylene oxide and 2 moles of oleic acid (Synlube 728 manufactured by Milliken Chemical Co.) and the rest water. The secondary finish consists of 37.89% of the same lubricant (Ucon 5100) and 2.11% of polyethylene amine (PEI-6 manufactured by Dow Chemical Co.) and the rest water.

For staple Item B, the primary finish consists of 14.04% of the same ethylene/propylene copolymer polyalkylene glycol lubricant; 2.63% of the same perfluoroalkyl citrate urethane; 1.33% of the same epoxy; 2% of the ethoxylated castor oil; and the rest water. The secondary finish consists of 37.7% of the same lubricant as used in the primary, and 2.38% of the same polyethylene amine, and the rest water.

In both cases, a dilute predraw finish is applied on the draw machine prior to drawing (consisting of 4% of the Ucon 5100 (used above) and 1.4% of triethanolamine and the rest water) by means of a finish roll turning on the reverse direction to the tow to reduce any free epoxide concentration to less than 0.003%.

The ratio of epoxide to curing agent for Item A is 3.5 and for Item B is 4.2. The fluorochemical to epoxy ratio of Item A is 1.0 and for Item B 1.5.

The staple fibers are processed into yarn and then into a carpet for a floor test of antiosoiling performance. Fluorine analyses on yarn are found to be 803±46 and 1321±170 for A and B respectively, and on carpet 281±9 and 382±45 respectively. After 34,000 cycles in a floor test including control carpets (containing commercial topically applied antisoiling compositions), both test items are found to perform substantially equivalently to the control items and considerably better than a control carpet with no fluorochemical.

We claim:

1. A process for producing synthetic polyamide filaments of enhanced soil resistance through the application of a fluorochemical antisoiling agent to the filaments as a yarn finish during a melt-spinning process which comprises applying to freshly solidified filaments a first finish composition containing a textile lubricant, an antisoiling fluorochemical and an epoxy resin having an epoxy equivalent of less than 200 and a molecular weight of less than 500 and subsequently applying any curing agent to substantially remove all of any free epoxide, such that the synthetic polyamide filaments resist soiling.

2. A process of claim 1 wherein a second finish composition is subsequently applied to the filaments which second finish contains a textile lubricant and a curing agent for the epoxy resin.

3. A process of claim 2 wherein the fluorochemical comprises a perfluoroalkyl ester of a carboxylic acid containing 3 to 30 carbon atoms and the perfluroalkyl radical contains 6 to 14 carbon atoms.

4. A process of claim 3 wherein the filaments are heated after the first finish is applied and prior to being packaged to a temperature sufficient to soften and cause flowing of the fluorochemical.

5. A process of claim 2 wherein the first finish is applied as a primary spin finish to the freshly spun filaments prior to their being drawn.

6. A process of claim 1 wherein the fluorochemical is a perfluoroalkyl citrate tri-ester bis-urethane of a fluorinated alcohol of the formula $C_nF_{2n+1}(CH_2)_2OH$ and the citric acid bis-urethane is of 1,6-hexamethylene diisocyanate; the epoxy resin is a diglycidyl ether of bisphenol A and the curing agent is polyethylene imine.

7. A process of claim 6 wherein the first and second finish compositions contain a copolyalkylene glycol ether textile lubricant.

* * * * *